US007037106B2

(12) United States Patent
Shefsiek

(10) Patent No.: US 7,037,106 B2
(45) Date of Patent: May 2, 2006

(54) APPARATUS FOR UNIFORM FLOW DISTRIBUTION OF GAS IN PROCESSING EQUIPMENT

(75) Inventor: Paul Shefsiek, Conneaut Lake, PA (US)

(73) Assignee: Seco/Warwick Corporation, Meadville, PA (US)

( * ) Notice: Subject to any disclaimer, the term of this patent is extended or adjusted under 35 U.S.C. 154(b) by 0 days.

(21) Appl. No.: 10/929,674

(22) Filed: Aug. 31, 2004

(65) Prior Publication Data

US 2006/0046222 A1 Mar. 2, 2006

(51) Int. Cl.
*F24C 15/32* (2006.01)

(52) U.S. Cl. ..... 432/251; 126/21 A

(58) Field of Classification Search ..... 432/9, 432/144, 145, 147, 152, 175, 176, 251; 126/92 C, 126/21 A, 273 R
See application file for complete search history.

(56) References Cited

U.S. PATENT DOCUMENTS

| | | | | |
|---|---|---|---|---|
| 3,590,803 A | | 7/1971 | Sauer | |
| 3,708,156 A | | 1/1973 | Leland | |
| 3,977,387 A | | 8/1976 | Lawler | |
| 4,029,463 A | | 6/1977 | Johansson et al. | |
| 4,722,683 A | * | 2/1988 | Royer | 432/152 |
| 5,075,120 A | | 12/1991 | Leary et al. | |
| 5,259,758 A | * | 11/1993 | Lauersdorf | 432/251 |
| 5,568,802 A | | 10/1996 | Buday et al. | |
| 6,168,426 B1 | * | 1/2001 | Yamada | 432/152 |
| 6,874,495 B1 | * | 4/2005 | McFadden | 126/21 A |
| 2004/0123858 A1 | | 7/2004 | McFadden | |

FOREIGN PATENT DOCUMENTS

JP A-136922 8/1983

* cited by examiner

*Primary Examiner*—Gregory Wilson
(74) *Attorney, Agent, or Firm*—Oliff & Berridge, PLC

(57) ABSTRACT

A uniform flow control system for processing equipment with a plurality of work pieces located within the processing equipment, including a gas circulating device that circulates gas, a work chamber that can accommodate the plurality of work pieces and an expansion chamber that is located outside the work chamber and that guides gas to the work chamber. The expansion chamber includes a first chamber that extends along a first surface of the work chamber, a second chamber that extends along a second surface of the work chamber to a side of the first chamber, and a third chamber that extends from an end of the first chamber that is opposite the gas circulating device and below an end of the second chamber that is opposite the gas circulating device.

24 Claims, 7 Drawing Sheets

APPARATUS FOR UNIFORM FLOW DISTRIBUTION OF GAS IN PROCESSING EQUIPMENT

BACKGROUND OF THE INVENTION

1. Field of Invention

The invention relates generally to processing equipment. More particularly, the invention relates to a system for treating a work piece with a uniform flow distribution.

2. Description of Related Art

There exists furnaces, as an example of processing equipment, that are used to treat various work pieces. Typically, a work piece is placed in a furnace and the temperature of the work piece is raised or lowered to a predetermined temperature. The treatment can be used for a wide variety of processes that include, for example, low temperature food processing to high temperature metallurgical processing. The temperature of the work piece is maintained at the predetermined temperature for a selected period of time until the work piece is sufficiently treated.

When the temperature of the work piece is raised or lowered to the predetermined temperature, gas in many cases is typically distributed and re-circulated throughout the furnace. The gas typically includes any type of gas including, for example, air, inert gas or a chemically reactive gas. Because of the requirements of the treating cycle and the characteristics of the material, it is important that the work piece not be heated higher than or cooled lower than a target temperature because various types of deterioration that can occur and it is important that all work pieces reach target temperature. When the gas is distributed and re-circulated throughout the furnace, the temperature of the gas is thus preferably uniform. As such, all areas of the furnace are set at the same temperature so that the work pieces are uniformly heated to a temperature that is neither higher than nor lower than the target temperature.

SUMMARY OF THE INVENTION

However, using gas at a uniform temperature in order to maintain all of the areas of the furnace at the same temperature alone is not sufficient. One problem that can exist is that the temperature of the entire work piece, from the exterior of the work piece to the interior of the work piece, may not be uniformly heated or cooled. The flow of gas may also be concentrated at only a few work pieces while the remaining work pieces only receive a minimal amount of gas flow. A longer period of time is thus required to treat all of the work pieces so that all of the work pieces receive a sufficient amount of treatment. If the furnace is thus operated for longer periods of time, furnace operating expenses also increase.

A uniform flow rate for the gas is thus preferred. In particular, work piece to work piece uniformity will not be uniform if the flow rate of heating and cooling gas or the rate of delivery of the gas is not uniform. The circulation of gas around an individual workpiece affects the time temperature history of the work piece and thus its final properties.

One solution that has been used to provide the uniform flow rate is to adapt internal fixed flow directing baffles which are set through experimentation. The fixed baffles are typically used in furnaces that have a fixed design in combination with a specific type of work piece. Another solution is to use externally controlled movable baffles. Although the movable baffles are preferred over the fixed baffles, it is difficult to adapt any one method of moving the baffles to wide variations of the types of work pieces that are processed. Because it is difficult to adapt any one method of moving the baffles, the furnaces are typically set to one specific type of workpiece.

Accordingly, the aspects of the invention provide a system that produces uniform re-circulating gas flow in processing equipment that is relatively simple and economical to manufacture and assemble.

Aspects of the invention separately provide a system that produces uniform re-circulating gas flow in processing equipment that is independent of the work piece size and a system and method for material conveyance that can operate at high temperatures.

Aspects of the invention separately provide a system to produce uniform re-circulating gas flow in processing equipment that is essentially independent of any flow directing baffles or the configuration of the work piece that is being processed.

Aspects of the invention separately provide a system that produce uniform re-circulating gas flow in processing equipment that can provide high velocity gas flow for enhanced and improved heat transfer capability.

Aspects of the invention separately provide a uniform flow control system for processing equipment with a plurality of work pieces located within the processing equipment, that includes a gas circulating device that circulates gas, a work chamber that can accommodate the plurality of work pieces and an expansion chamber that is located outside the work chamber and that guides gas to the work chamber. The expansion chamber includes a first chamber that extends along a first surface of the work chamber, a second chamber that extends along a second surface of the work chamber to a side of the first chamber, and a third chamber that extends from an end of the first chamber that is opposite the gas circulating device and below an end of the second chamber that is opposite the gas circulating device.

Aspects of the invention separately provide a uniform flow control system for processing equipment with a plurality of work pieces located within the processing equipment, that includes an enclosure with a top wall, a bottom wall and side walls, a gas circulating device that circulates gas and that is located at the top wall of the enclosure, a first surface that generally vertically extends and in parallel spaced relation with the side walls of the enclosure, a second surface that generally horizontally extends and in parallel spaced relation with the bottom wall of the enclosure, wherein the second surface is below the first surface and the second surface includes at least one opening and a protrusion that is located at the bottom wall, wherein a top wall of the protrusion is located a first predetermined distance below the second surface and side walls of the protrusion are located a second predetermined distance from the side walls of the enclosure.

Aspects of the invention separately provide a uniform flow control system for processing equipment with a plurality of work pieces located within the processing equipment, that includes a gas circulating device that circulates gas, a work chamber that can accommodate the plurality of work pieces, and an expansion chamber that is located outside the work chamber and that guides gas to the work chamber. The expansion chamber includes a first chamber that extends along a first surface of the work chamber and that guides gas in a first direction into the work chamber, a second chamber that extends along a second surface of the work chamber to a side of the first chamber and that guides gas in a second direction into the work chamber, and a third chamber that is in communication with the first chamber and the second chamber, wherein gas turbulence is created in the third chamber before the gas enters the second chamber.

BRIEF DESCRIPTION OF THE DRAWINGS

Various embodiments of this invention will be described in detail, with reference to the following figures, wherein.

DETAILED DESCRIPTION OF EXEMPLARY EMBODIMENTS

Figure 1:
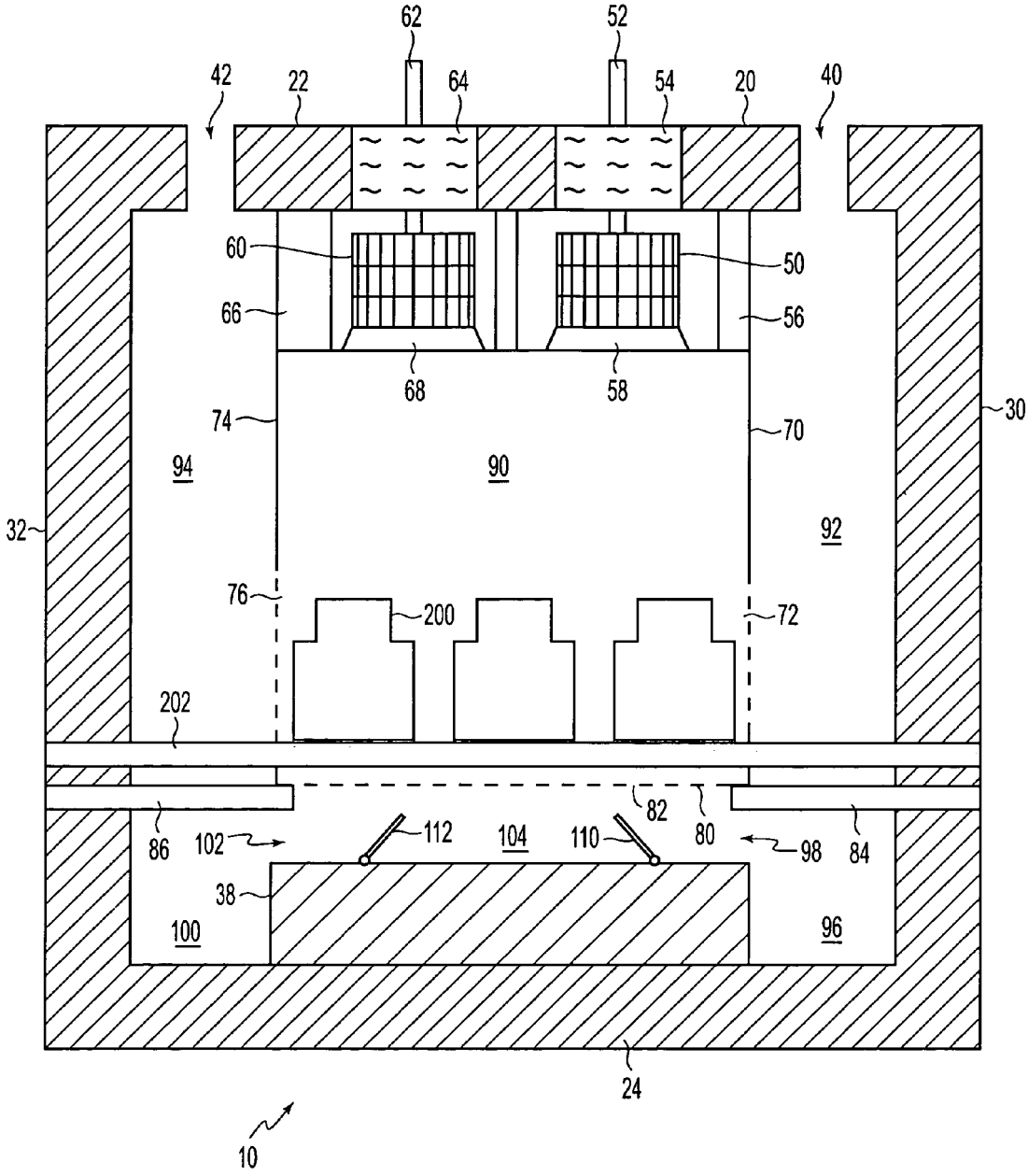
FIG. 1 is a sectional view from a side of an improved furnace according to an embodiment the invention.
Figure 2:
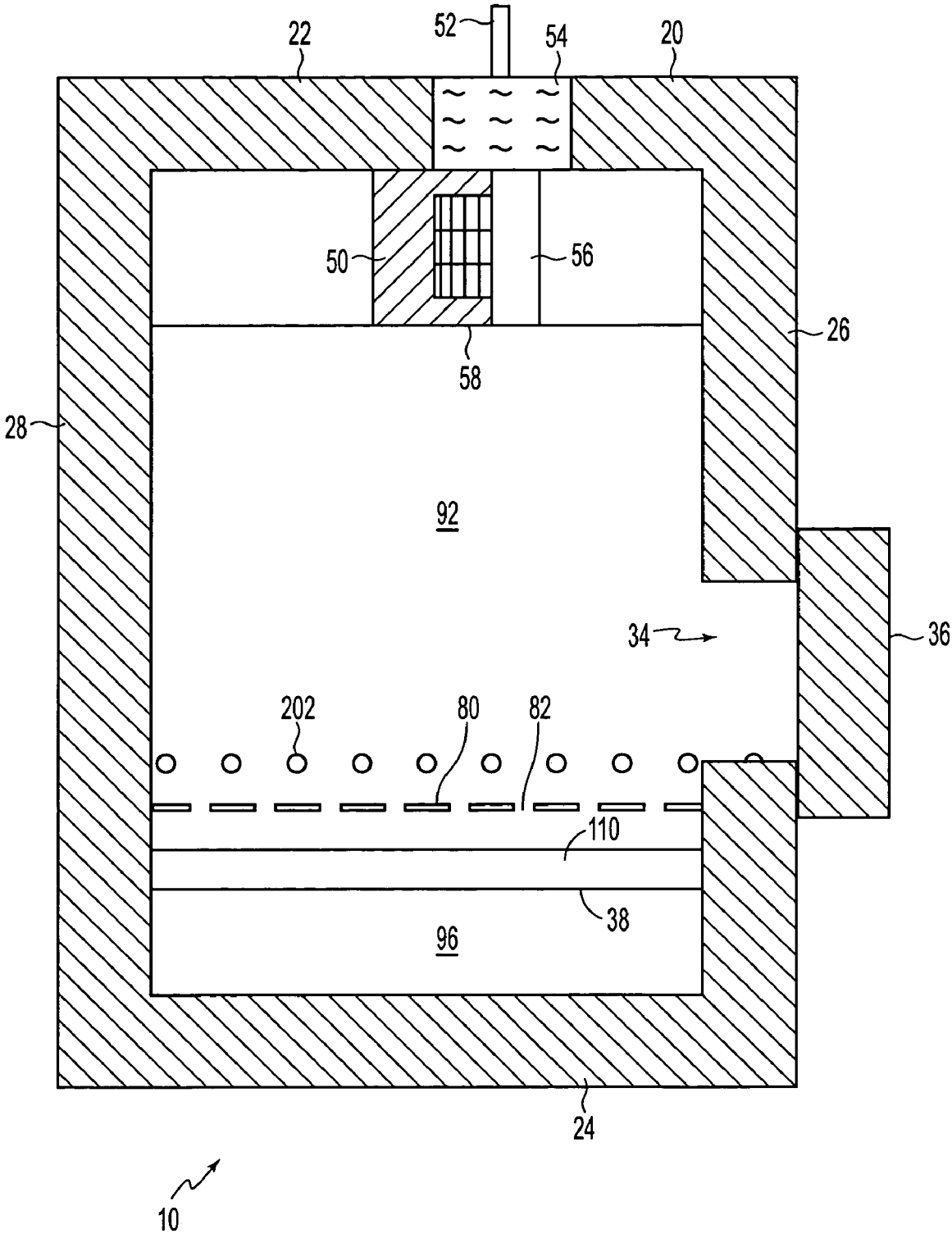
FIG. 2 is a side view of the furnace of FIG. 1 with portions cut away to expose the interior thereof.
Figure 3:
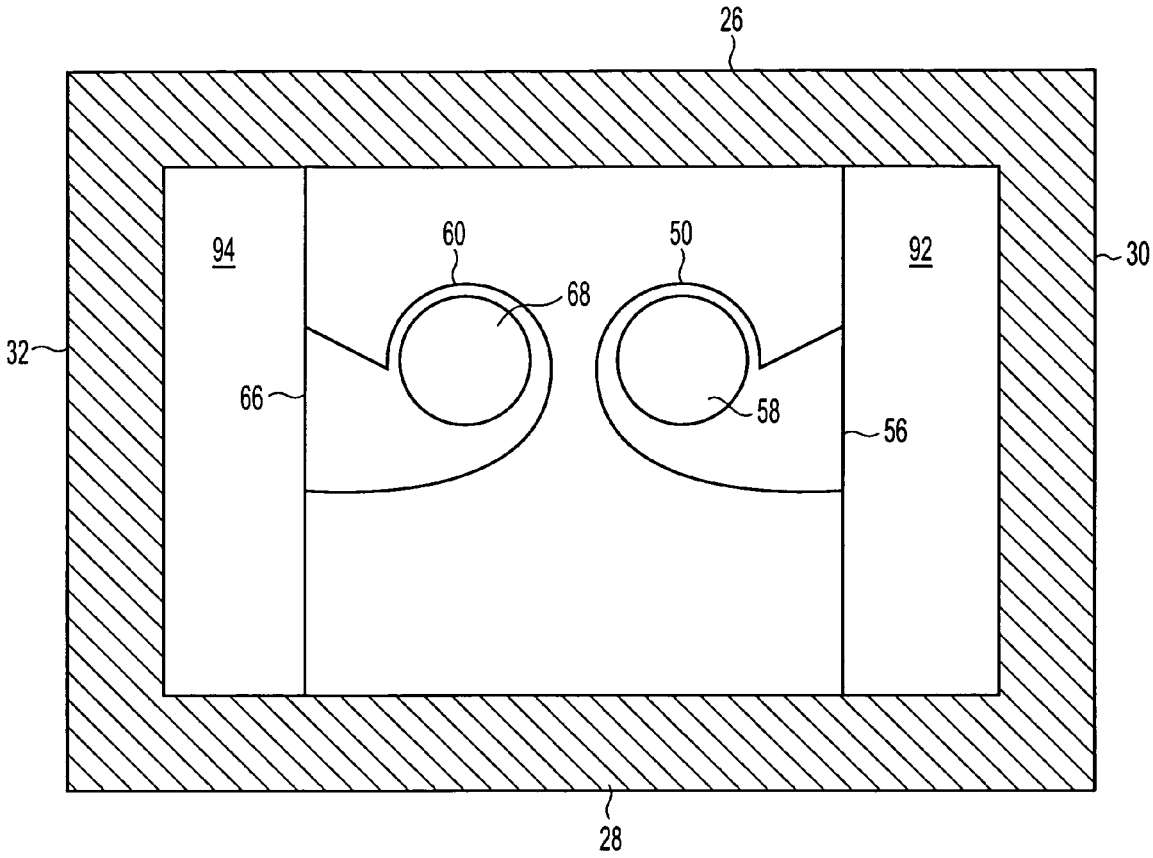
FIG. 3 is a top view of the furnace of FIG. 1 with portions cut away to expose the interior thereof.

Referring now in detail to the drawings, there is illustrated in FIGS. 1–3, a furnace as an example of processing equipment. For simplicity and clarification, the operating principles and design factors of the invention are explained with reference to an embodiment of a furnace according to the invention, as shown in FIGS. 1–3. The basic explanation of the operation of the furnace shown in FIGS. 1–3 is applicable for the understanding and design of any processing equipment that incorporates the uniform flow systems and methods according to the invention.

FIGS. 1–3 show a batch type furnace 10, preferably of metal construction, with a layer of insulating refractory material on the interior to form an insulated enclosure 20. The enclosure 20 has a generally horizontal top wall 22 and bottom wall 24, a generally vertical front wall 26 and rear wall 28, and generally vertical side walls 30, 32. The front wall 26 is formed with a large entrance opening 34 which is adapted to be closed by a vertically slidable door 36. As should be appreciated, the rear wall 28 can also be formed with a large entrance opening which is adapted to be closed by a vertically slidable door. The enclosure 20 also includes a platform 38 as an example of a protrusion that is attached to or integral with the bottom wall 24. The platform 38 also extends between the front wall 26 and the rear wall 28 as shown in FIG. 2.

The top of the furnace 10 is closed by the horizontally extending top wall 22 which also serves as a support for two gas circulating fans 50, 60. The circulating fans 50, 60 each include a vertically extending supporting shaft 52, 62 journaled in a mounting frame 54, 64 carried by the top wall 22. Carried by the lower end of each shaft 52, 62 is a large axial flow fan member. To rotate the shafts 52, 62, a reversible motor (not shown) rotates the shafts 52, 62. The motor is reversible so that the shafts 52, 62 may be rotated in either direction to cause the fan member to either move gas upwardly or downwardly. In other embodiments, three or more circulating fans may be used. Further, the two circulating fans 50, 60 may be operated by a single reversible motor or by separate reversible motors. The two circulating fans 50, 60 are an example of a gas circulating device. As should be appreciated, any device currently available or later developed can be used as a gas circulating device that circulates gas throughout the processing equipment.

For illustrative purpose, the motor rotates the shaft so as to move gas upwardly. In other words, gas moves upwardly through the fan inlets 58, 68 and out through the fan outlets 56, 66. As also should be appreciated, although two gas circulating fans 50, 60 will be discussed, it should be appreciated that any fan currently available or later developed can be used to move gas. For example, the fans 50, 60 can be recirculating multi-blade fans (squirrel cage) fans.

Within the enclosure 20, there are two horizontal jet distribution plates 70, 74 as an example of a first surface and a vertical jet distribution plate 80 as an example of a second surface which form a work chamber 90 along with the front wall 26, the rear wall 28 and the circulating fans 50, 60 within the enclosure 20.

As shown in FIG. 1, the horizontal jet distribution plates 70, 74 extend vertically and are in parallel spaced relation with the side walls 30, 32. The horizontal jet distribution plates 70, 74 are also positioned below the circulation fans 50, 60 and between the front wall 26 and the rear wall 28 so that the gas is guided upward toward the circulation fans 50, 60. As should be appreciated, the horizontal jet distribution plates 70, 74 can be attached to or integral with either of the circulation fans 50, 60, the top wall 22 or the front wall 26 and the rear wall 28.

The horizontal jet distribution plates 70, 74 include openings 72, 76 located at a lower portion of the horizontal jet distribution plates 70, 74 and between the front wall 26 and the rear wall 28. The openings 72, 76 extend from the bottom of the horizontal jet distribution plates 70, 74 to any arbitrary position. In various embodiments, the openings 72, 76 extend near to the middle of the horizontal jet distribution plates 70, 74. The openings 72, 76 can also extend to a position that is above or below the top of the work pieces that are commonly placed in the furnace 10. As should be appreciated, the height of the openings 72, 76 of the horizontal jet distribution plates 70, 74 need not be higher than the opening 34 or the door 36.

Located below the horizontal jet distribution plates 70, 74 is a vertical jet distribution plate 80 that extends horizontally in parallel spaced relation with the bottom wall 24. As should be appreciated, the vertical jet distribution plate 80 can be attached to or integral with either the horizontal plates 70, 74 or with the front wall 26 and the rear wall 28. In this embodiment, the vertical jet distribution plate 80 is supported by supports 84, 86 that extend from the side walls 30, 32. The vertical jet distribution plate 80 can also include any desired shape. In this example, a square shape will be used for the vertical jet distribution plate 80. The vertical jet distribution plate 80 also includes openings 82 located along the substantial surface of the vertical jet distribution plate 80, preferably the entire surface, between the front wall 26 and the rear wall 28.

Within the enclosure 20 and outside of the work chamber 90 are expansion chambers 92, 94 as an example of a first chamber. As shown in FIG. 1, the top wall 22, the side wall 30, the circulating fan 50, the horizontal jet distribution plate 70, an opening 98 and a generally horizontal line that connects the top of the platform 38 to the side wall 30 define the expansion chamber 92. As shown in FIG. 1, the opening 98 is formed between the top of the platform 38 and a bottom of the support 84. As such, the opening 98 is located a predetermined distance above the bottom wall 24. In accordance with an exemplary embodiment of the invention, the opening 98 is located at a generally vertical line that connects the horizontal jet distribution plate 70 and the platform 38 and is in parallel spaced relation with the side wall 30.

Similarly, the top wall 22, the side wall 32, the circulating fan 60, the horizontal jet distribution plate 72, an opening 102 and a generally horizontal line that connects the top of the platform 38 to the side wall 32 define the expansion chamber 94. As shown in FIG. 1, the opening 102 is formed between the top of the platform 38 and a bottom of the support 86. As such, the opening 102 is located a predetermined distance above the bottom wall 24. In accordance with an exemplary aspect of the invention, the opening 102 is located at a generally vertical line that connects the horizontal jet distribution plate 72 and the platform 38 and is in parallel spaced relation with the side wall 32.

In accordance with an exemplary aspect of the invention, the vertical downward circulating area of the expansion chambers 92, 94 (i.e., the area defined by the front wall 26, rear wall 28, side walls 30, 32 and horizontal jet distribution plates 70, 74) should be three to four times the area of the fan outlets 56, 66 in order to promote uniform gas flow distribution, as discussed below, and to conserve energy and reduce noises that are created when gas is circulated. However, as should be appreciated, any vertical downward circulating area can be used.

Also, in accordance with an exemplary aspect of the invention, the area of the openings 98, 102 should be two to three times the area of the fan outlets 56, 66 in order to promote uniform distribution to the openings 82 of the vertical jet distribution plate 80 and to conserve energy and reduce noises that are created when gas is circulated. However, as should be appreciated, any area can be used.

Within the enclosure 20 and below the expansion chambers 92, 94 are expansion chambers 96, 100 as an example of a third chamber. As shown in FIG. 1, the bottom wall 24, the platform 38, the side wall 30, and the generally horizontal line that connects the top of the platform 38 to the side wall 32 define the expansion chamber 96. In other words, the expansion chamber 96 is below the opening 98 in which gas is circulated to the vertical jet distribution plate 80. Similarly, the bottom wall 24, the platform 38, the side wall 32, and the generally horizontal line that connects the top of the platform 38 to the side wall 32 define the expansion chamber 100. Again, the expansion chamber 100 is below the opening 102 in which gas is circulated to the vertical jet distribution plate 80.

In accordance with an exemplary aspect of the invention, the height of the expansion chambers 96, 100 from the bottom wall 24 to the top of the platform 38 should be about twelve inches in order to promote uniform gas flow, as discussed below, and to create a sufficient back pressure. However, as should be appreciated, any height can be used.

Within the enclosure 20 and below the work chamber 90 is an expansion chamber 104 as an example of a second chamber. The platform 38, the vertical jet distribution plate 80 and the openings 98 and 104 define the expansion chamber 104. The expansion chamber 104 also includes distribution guides 110, 112. The distribution guides 110, 112 are attached to or integral with the platform 38 and are slanted upward toward the vertical jet distribution plate 80. As should be appreciated, the expansion chambers 92, 94, 96, 100 and 104 combine to form an H-shaped chamber as shown in FIG. 1.

The furnace 10 is designed to handle a wide range of work pieces 200. As shown in FIG. 2, in order to transport the work pieces into and out of the furnace 10, there is provided a set of rollers 202 that can be used to roll the workpieces 200 in and out of the furnace 10. As should be appreciated, any device currently available or later developed can be used to transport the work pieces 200 in and out of the furnace 10. In accordance with an exemplary aspect of the invention, the distance between the maximum height of the work pieces 200 and the fan inlets 58, 68 should be a minimum of two times the diameter of the fan inlets 58, 68 in order to promote uniform gas flow. However, as should be appreciated, any distance can be used.

To heat or cool the gas within the furnace, a plurality of electric or gas radiant tube heaters or a cooler can be inserted through openings 40, 42 in the top wall 22 or suitable direct fired gas burners can be positioned within or above the furnace 10. Gas or any atmosphere can also be introduced into the openings 40, 42. Under normal operating conditions, the fan members 50, 60 are rotated in such a direction as to draw gas upwardly into the fan inlets 58, 68. The gases then move outwardly through the fan outlets 56, 66. As such, any treating material or device currently available or later developed can be used such that workpieces 200 are treated when the fan members 50, 60 draw gas from the fan inlets 58, 68 to the fan outlets 56, 66.

Work pieces are particularly difficult to treat properly. The work pieces have a tendency to insulate the interior portions, therefore making it difficult to bring the entire volume of material up to or down to the desired temperature at which it should be soaked for a selected period of time. Because of this thermal lag between the interior and the exterior of the work piece, there is a danger that the interior portions may not be completely treated. In instances where high temperatures are employed in an effort to heat the interior of the work piece, there is a danger that the exterior portions of the work piece will be overheated or overcooled thereby damaging the grain structure of the material.

It is common to recirculate gases in the furnace 10 at a rate of five to six hundred feet per minute. However, the furnace 10 is provided with horizontal jet distribution plates 70, 74 and a vertical jet distribution plate 80 to produce gas at velocities from one thousand to five thousand or more local to the work pieces. This tremendously increased rate of local gas flow improves the transfer of heat or coolness between the circulating gas and the workpieces.

As discussed above, gas within the work chamber 90 is circulated throughout the work chamber 90. In various embodiments, the atmosphere is gas or more often a special atmosphere, such as a nitrogen mixtures of nitrogen, hydrogen, carbon monoxide and carbon dioxide as examples. However, any gas or atmosphere can be used within the work chamber 90.

Figure 4:
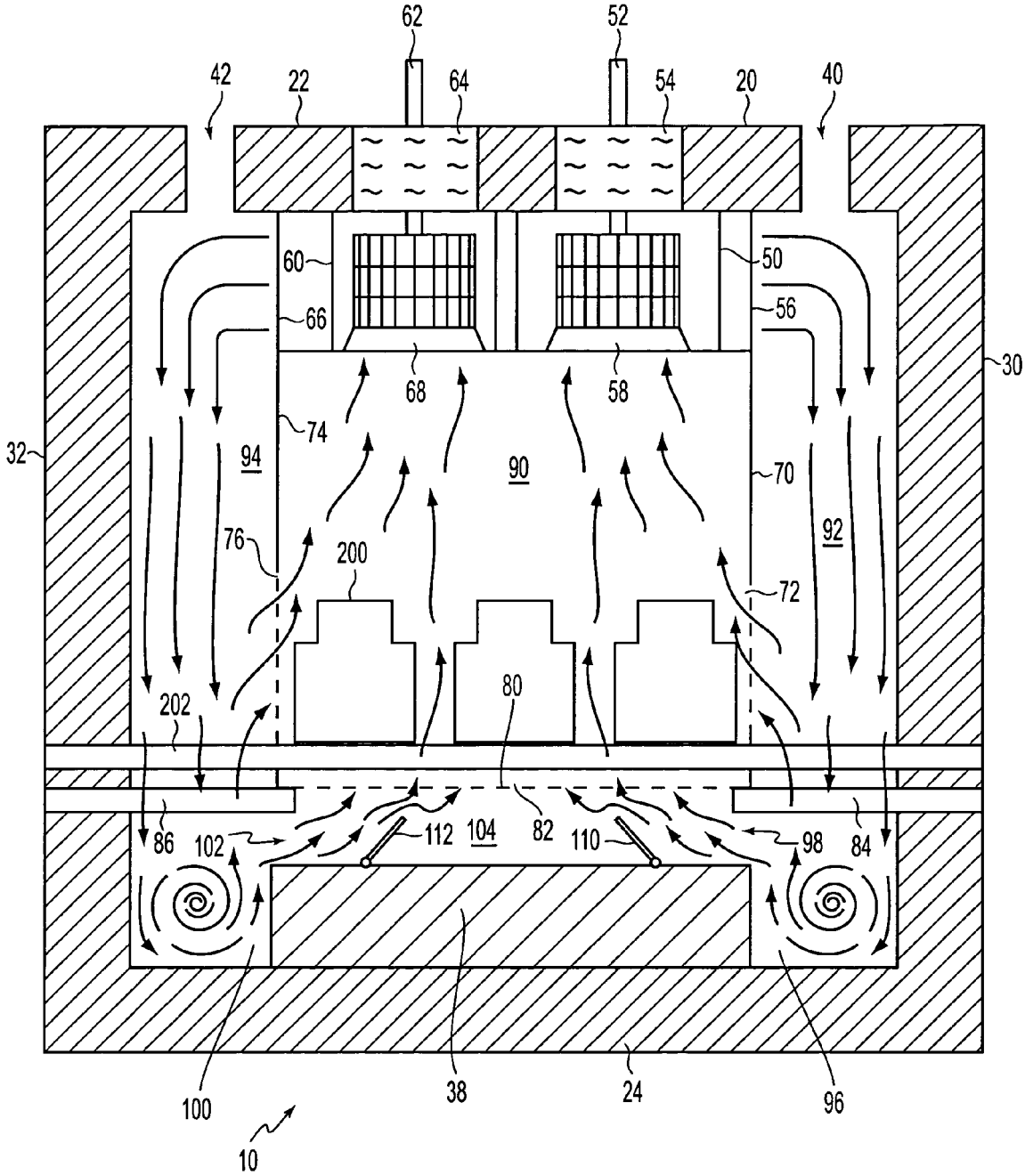
FIG. 4 is a sectional view illustrating the flow of gases from a side of the improved furnace according to an embodiment the invention.
Figure 5:
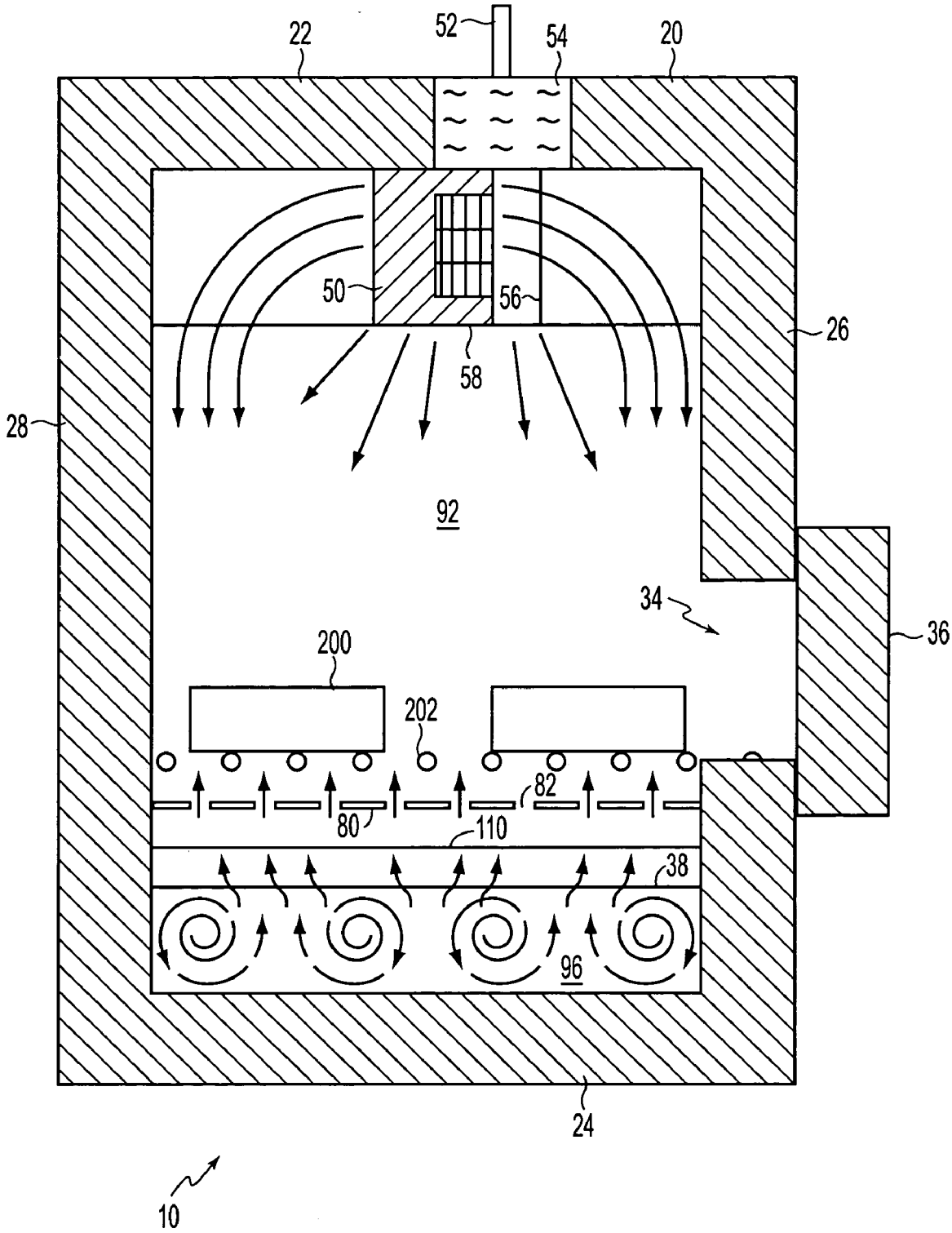
FIG. 5 is a side view of the furnace of FIG. 4 with portions cut away to expose the interior thereof.
Figure 6:
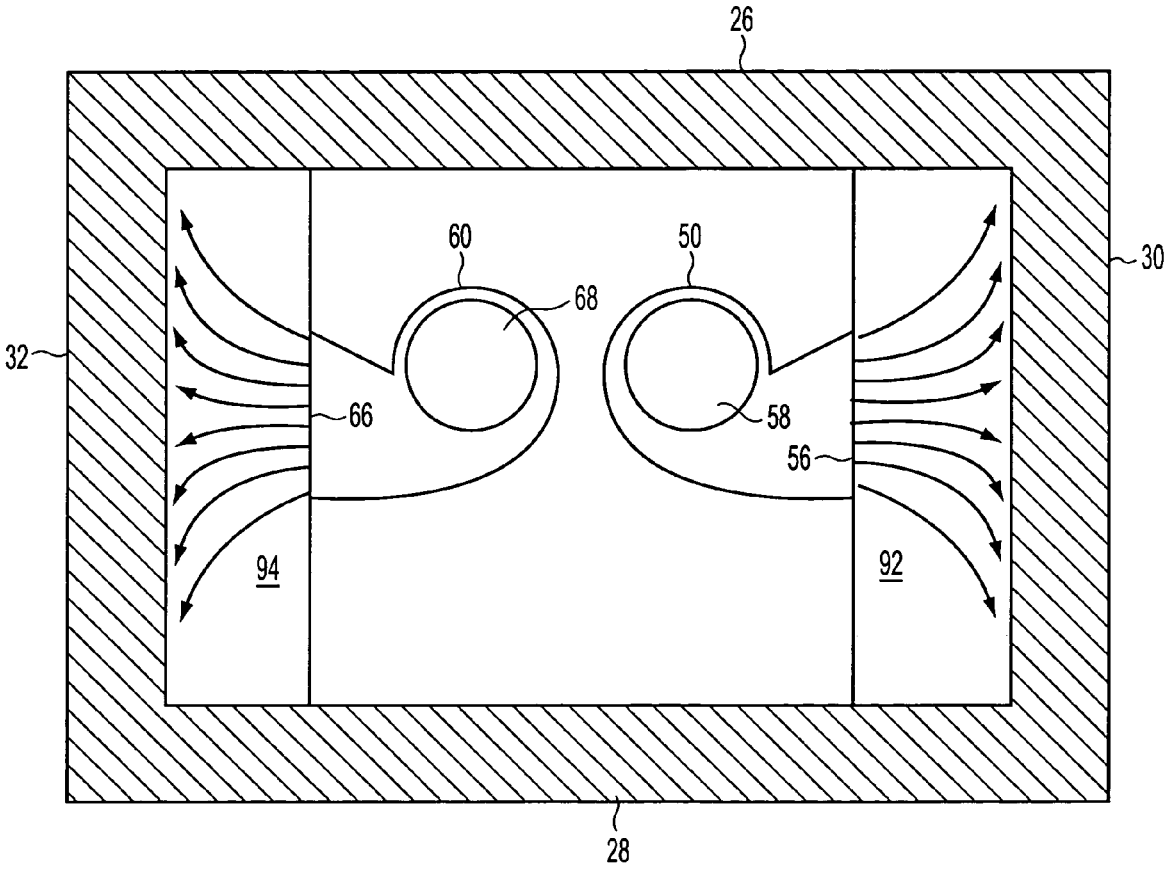
FIG. 6 is a top view of the furnace of FIG. 5 with portions cut away to expose the interior thereof.

Reference will now be made to FIGS. 4–6 in order to explain how gas is uniformly circulated throughout the furnace 10 independent of any flow directing baffles and independent of the configuration of the work pieces 200. A description will first be provided in order to explain how gas circulates from the fan outlets 56, 66 and into the openings 72, 76 of the horizontal jet distribution plates 70, 74 and into the openings 98, 102. A description will then be provided in order to explain how gas circulates from the openings 98, 102 and into the openings 82 of the vertical jet distribution plate 80. Finally, a description will be provided in order to explain how gas circulates from the openings 72, 76 of the horizontal jet distribution plates 70, 74 and the openings 82 of the vertical jet distribution plate 80 into the fan inlets 58, 68.

As shown in FIGS. 4–6, when gas exits the fan outlet 56, the gas first enters into the expansion chamber 92. When the gas first enters the expansion chamber 92, as shown in FIG. 6, the gas generally expands and impinges on the sidewall 30. As shown in FIGS. 5 and 6, some of the gas that exits the fan outlet 56 immediately changes direction toward the front wall 26 and the rear wall 28 before reaching the sidewall 30. Furthermore, as shown in FIG. 5, some of the gas that exits the fan outlet 56 also immediately changes direction toward the top wall 22 or vertically downward before reaching the sidewall 30. Uniform gas flow is thus immediately created because some of the gas immediately moves in all directions (up, down, front, rear, and side to side) upon leaving the fan outlet 56. In other words, gas is equally distributed throughout the expansion chamber 92. Furthermore, by removing all flow direction vanes at the fan outlet 56, the gas can thus flow in all possible directions after impinging upon the sidewall 30 because the gas is not being forced in a specific direction. Thereafter, the gas flows downward in the vertical direction. As should be appreciated, because the gas is uniformly distributed upon leaving the fan outlet 56, the gas also has additional time to distribute uniformly as the gas moves downward in the expansion chamber 92.

Thereafter, the gas then begins to circulate vertically downward in the expansion chamber 92 between the front wall 26, the rear wall 28, the side wall 30 and the horizontal jet distribution plate 70 toward the expansion chamber 96. When the gas initially circulates past the top opening 72 of the horizontal jet distribution plate 70, some of the gas initially passes through the openings 72 of the horizontal jet distribution plate 70 and the opening 98. However, most of the gas initially circulates to the expansion chamber 96 which is located below the top of the platform 38. Most of the gas circulates to the expansion chamber 96 because the dynamic forward velocity of the downwardly circulating gas causes most of the gas to enter the expansion chamber 96 before entering the openings 72, 98. Gas within chamber 96 provides additional turbulence, which enhances longitudinal gas flow uniformity.

By placing the expansion chamber 96 below the top of the platform 38, the gas is further uniformly distributed between the front wall 26 and the rear wall 28. Furthermore, uniform back pressure in the expansion chamber 96 is also created so that the gas uniformly approaches the openings 72 of the horizontal jet distribution plate 70 and the opening 98. By placing the openings 72 and 98 away from the end of a chamber or away from any significant turns in the gas circulation path, an opening is not located at a position where the concentration of the gas pressure at a specific location is high. In other words, if an opening was placed at a bottom of the expansion chamber 96, more gas would pass through that opening than any of the openings 70, 98 because the gas pressure is greater at the bottom of the expansion chamber 96. This increased gas pressure is avoided by creating back pressure.

After the gas passes into the expansion chamber 96 below the platform 38 and a sufficient amount of back pressure has been created, the velocity by which the gas circulates from the expansion chamber 92 through the opening 98 and the openings 72 of the horizontal distribution plate 70 thus increases.

As shown in FIGS. 4–6, when gas exits the fan outlet 66, the gas first enters into the expansion chamber 94. When the gas first enters the expansion chamber 94, as shown in FIG. 6, the gas generally expands and impinges on the sidewall 32. As shown in FIGS. 5 and 6, some of the gas that exits the fan outlet 66 immediately changes direction toward the front wall 26 and the rear wall 28 before reaching the sidewall 32. Furthermore, as shown in FIG. 5, some of the gas that exits the fan outlet 66 also immediately changes direction toward the top wall 22 or vertically downward before reaching the sidewall 32. The same effects and advantages that are obtained when the gas exits the fan outlet 56 into the expansion chamber 92 are thus obtained when the gas exits the fan outlet 66 and into the expansion chamber 94.

Thereafter, the gas then begins to circulate vertically downward in the expansion chamber 94 between the front wall 26, the rear wall 28, the side wall 32 and the horizontal jet distribution plate 74 toward the expansion chamber 100. When the gas initially circulates past the top opening 76 of the horizontal jet distribution plate 74, some of the gas initially passes through the openings 76 of the horizontal jet distribution plate 74 and the opening 102. However, most of the gas initially circulates to the expansion chamber 100 which is located below the top of the platform 38. Most of the gas circulates to the expansion chamber 100 because the dynamic forward velocity of the downwardly circulating gas causes most of the gas to enter the expansion chamber 100 before entering the openings 76, 102. The same effects and advantages that are obtained when the gas circulates to the expansion chamber 96 are thus obtained with the gas circulates to the expansion chamber 100.

After the gas passes into the expansion chamber 100 below the platform 38 and a sufficient amount of back pressure has been created, the velocity by which the gas circulates from the expansion chamber 94 through the opening 102 and the openings 76 of the horizontal distribution plate 74 thus increases.

After the gas circulates past the openings 98, 102, the gas then enters into the expansion chamber 104. As should be appreciated, if the circulating fans 50, 60 circulate gas at the same velocity and the enclosure 20 has a symmetric structure, gas should circulate though the openings 98, 102 at the same velocity. However, in accordance with another embodiment, the gas can also circulate through the openings 98, 102 or the openings 72, 76 of the horizontal jet distribution plates 70, 74 at different velocities. For illustrative purposes, the gas will be described as circulating through the openings 98, 102 at the same velocity.

When the gas circulates past the openings 98, 102, the gas initially circulates in a generally horizontal direction. In other words, the gas does not initially circulate vertically and into the openings 82 of the vertical jet distribution plate 80. As such, when the gas circulates without interruption, the gas from the opening 98 and the gas from the opening 102 will contact each other at the middle of the expansion chamber 104 before moving vertically. The gas will thus pass through the openings 82 at the center of the vertical distribution plate 80 at a higher velocity than at the ends of the vertical distribution plate 80.

In order to create a uniform flow through the openings 82, the distribution guides 110, 112 are thus placed on top of the platform 38. The distribution guides 110, 112 are also slanted upwardly toward the center of the vertical jet distribution plate 80. The distribution guides 110, 112 thus restrict the flow of gas to the center of the vertical jet distribution plate 80 by deflecting the gas flow upwardly and towards the ends of the vertical jet distribution plate 80. Transverse horizontal gas circulation is thus promoted, resulting in uniform gas flow upwardly through the openings 82.

In accordance with an exemplary aspect of the invention, as shown in FIG. 5, the guides 110, 112 should have a length that is the same from the front wall 26 to the rear wall 28 of the vertical jet distribution plate 80 and a width equal to 60 to 80 percent of the height of the expansion chamber 104. However, as should be appreciated, any length and height can be used. In accordance with another exemplary aspect of the invention, the guides 110, 112 should also be placed at an angle of twenty to sixty degrees from the top surface of the platform 38 and at a distance from the openings 98, 102 equal to ten to twenty five percent of the width of the vertical jet distribution plate 80.

After the gas circulates past the openings 72, 76 of the horizontal jet distribution plates 70, 74 and the openings 82 of the vertical jet distribution plate 80, the gas impinges and passes by the work pieces 200. As should be appreciated, by providing uniform gas circulation from the openings 72, 76 of the horizontal jet distribution plates 70, 74 and the openings 82 of the vertical jet distribution plate 80, the work pieces 200 gas flow measurements can be maintained within two percent. As such, the heating and cooling rate can be significantly increased. After the gas impinges and passes by the work pieces 200, the gas then mixes and circulates vertically into the fan inlets 58, 68.

In order to heat treat or cool the work pieces 200, it is desirable to set the velocity at which the gas circulate through the openings 72, 76 of the horizontal jet distribution plates 70, 74 and the openings 82 of the vertical jet distribution plate 80 as high as possible. However, in order to conserve energy and to reduce noise, gas circulation should be limited. Furthermore, in consideration of the space requirements of the enclosure 20 and the characteristics of the circulating fans 50, 60, the maximum velocity would require the open area of the openings 72, 76 of the horizontal jet distribution plates 70, 74 and the openings 82 of the vertical jet distribution plate 80 to be in the range of 10 to 15 percent of the total active plate area of the horizontal jet distribution plates 70, 74 and the vertical jet distribution plate 80. Furthermore, in order to conserve energy and to reduce noise, the amount of gas that exits the circulating fans 50, 60 should also be limited.

In accordance with an exemplary aspect of the invention, gas is uniformly circulated both in the horizontal and vertical direction in order to impinge on and pass by the work pieces. However, as should be appreciated, gas can be uniformly circulated in one of the horizontal or vertical direction. Furthermore, if gas is circulated in both the horizontal and vertical direction, the influence in which the gas has when the gas circulates in the horizontal and vertical direction can also be adjusted by selecting appropriate open areas for the openings 96, 102 and the openings 72, 76 of the horizontal jet distribution plates 70, 74 and the openings 82 of the vertical jet distribution plate 80.

Figure 7:
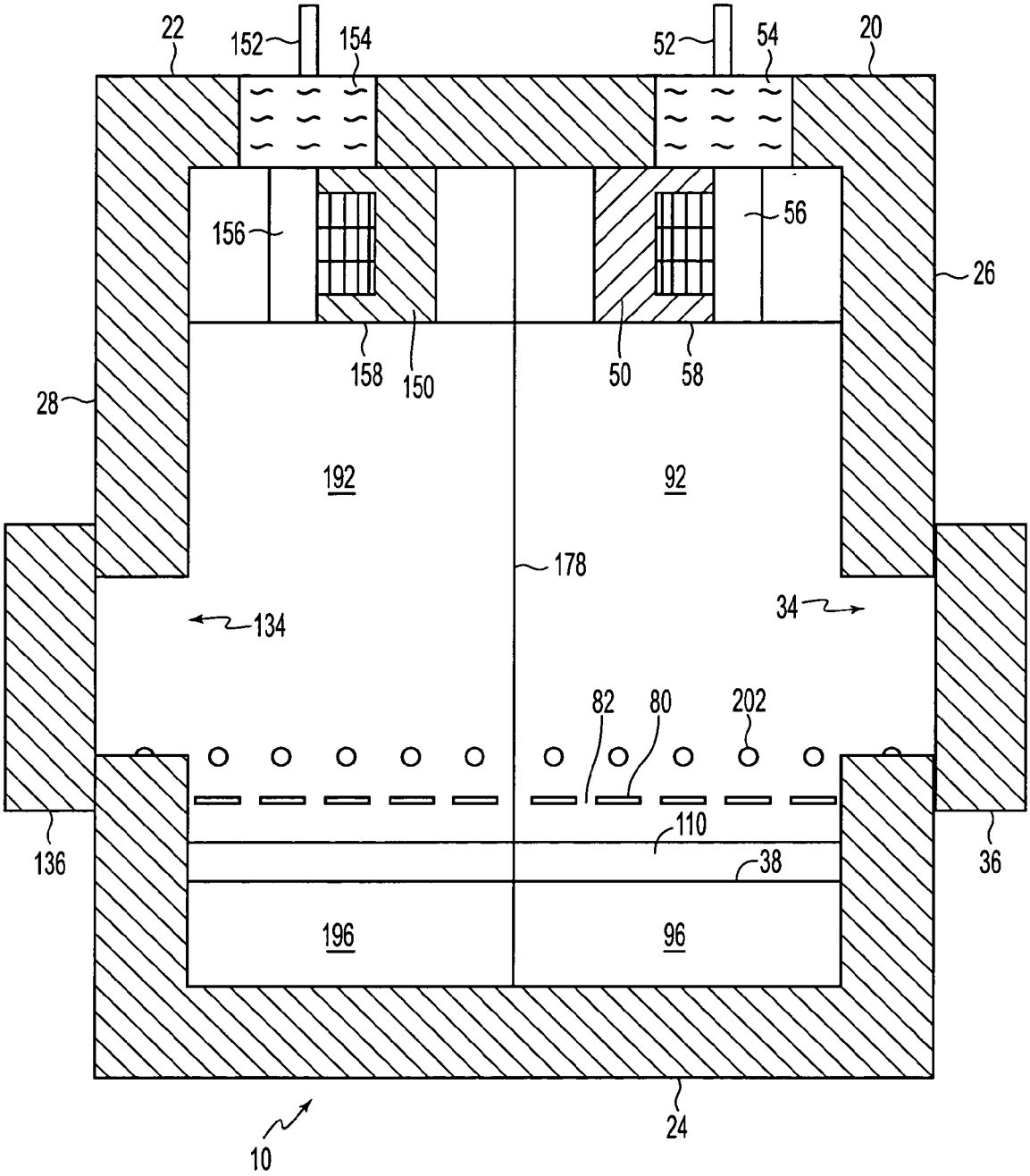
FIG. 7 is a side view of the furnace according to a modification of the invention with portions cut away to expose the interior thereof.

In FIGS. 1–3, a batch type furnace 10 was described. However, the objects and principles of the invention can also be applied to a multi zone continuous furnace 10 as shown in FIG. 7.

In the multi zone continuous furnace 10, each expansion chamber is divided into multiple expansion chambers and gas is circulated through the expansion chambers and into the openings 72, 76 of the horizontal jet distribution plates 70, 74 and the openings 82 of the vertical jet distribution plate 80 into various zones of the work chamber 90. Uniform gas circulation is thus promoted in long continuous furnaces 10 where a large distance exists between the front wall 26 and the rear wall 28. Gas also does not have to be circulated throughout the entire work chamber 90 at the same velocity. Instead, gas can be uniformly circulated at one velocity at a first zone and uniformly circulated at another velocity at another zone within the work chamber 90. Different velocities within the work chamber 90 may be desired when the entire work chamber 90 is not being utilized or if certain work pieces are cooling or heating at a higher rate than other work pieces, for example.

The furnace 10 will be described as including two zones i.e., a front zone and a rear zone) within the work chamber 90. Reference will be made to FIG. 7 in describing the additional structure as similar reference numerals will be used to represent the similar features of FIGS. 1–3. As shown in FIG. 7, the front wall 26 is formed with a large entrance opening 34 which is adapted to be closed by a vertically slidable door 36 and the rear wall 28 is formed with another large entrance opening 134 which is adapted to be closed by a vertically slidable door 136. Within the enclosure 20 is a divider 178 which is used to divide the expansion chambers into front expansion chambers and rear expansion chambers. The divider 178 extends between the top wall 22 and the bottom wall 24, between the side walls 30, 32 and the horizontal jet distribution plates 70, 74, openings 98, 102 and platform 38 and between the platform 38 and the vertical jet distribution plate 80. The divider 178 is also in parallel spaced relation with the front wall 26 and the rear wall 28. In other words, the divider 178 divides the H-shaped expansion chamber of FIG. 1 into two H-shaped expansion chambers. Although two H-shaped expansion chambers will be described, it should be appreciated that any number of H-shaped expansion chambers can be used in order to circulate gas into the work chamber 90 in any number of zones.

In this embodiment, the top wall 22 serves as a support for at least four gas circulating fans with gas circulating fans 50, 150 on each side of the divider 178 and on each side of the work chamber 90. Similar to FIG. 1, the circulating fans 50, 150 each include a vertically extending supporting shaft 52, 152 journaled in a mounting frame 54, 154 carried by the top wall 22. Carried by the lower end of each shaft 52, 152 is a large axial flow fan member. To rotate the shafts 52, 152, a reversible motor (not shown) rotates the shafts 52, 152. The motor is reversible so that the shafts 52, 152 may be rotated in either direction to cause the fan member to either move gas upwardly or downwardly. In other embodiments, five or more circulating fans may be used. Further, the two circulating fans 50, 150 may be operated by a single reversible motor or by separate reversible motors. Similar circulating fans would be used for the other side of the work chamber 90. As further should be appreciated, the gas circulating fans 50, 150 can circulate gas at the same or different velocities.

Within the enclosure 20 and outside of the work chamber 90 are expansion chambers 92, 192 as examples of a first chamber. As shown in FIG. 7, the top wall 22, the front wall 26, the top of the platform 38, the circulating fan 50, and the divider 178 define the expansion chamber 92. Similarly, the top wall 22, the rear wall 28, the top of the platform 38, the circulating fan 150, the horizontal jet distribution plate 70 and the divider 178 define the expansion chamber 192.

Within the enclosure 20 and below the expansion chambers 92, 192 are expansion chambers 96, 196 as examples of a third chamber. As shown in FIG. 7, the bottom wall 24, the front wall 26, the top of the platform 38 and the divider 178 define the expansion chamber 96. Similarly, the bottom wall 24, the rear wall 28, the top of the platform 38 and the divider 178 define the expansion chamber 196.

Although not shown, the divider 178 also similarly divides the expansion chambers 94, 100 and 104 of FIG. 1 into two expansion chambers (i.e., a front expansion chamber and a rear expansion chamber). As such, gas circulates from the fan outlet 56 to the fan inlet 58 and from the fan outlet 156 to the fan inlet 158 similar to the gas circulation as described in FIGS. 4–6. Uniform gas circulation can thus be achieved in both the front expansion chamber and the rear expansion chamber and into the front zone and the rear zone of the work chamber 90 in a manner that is similar to the single expansion chamber of FIG. 1.

Although the invention has been described with reference to what are preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A uniform flow control system for processing equipment with a plurality of work pieces located within the processing equipment, comprising:

a gas circulating device that circulates gas;

a work chamber that can accommodate the plurality of work pieces; and an expansion chamber that is located outside the work chamber and that guides gas to the work chamber, the expansion chamber comprising:

a first chamber that extends along a first surface of the work chamber;

a second chamber that extends along a second surface of the work chamber that is opposite the gas circulating device and to a side of the first chamber; and a third chamber that extends from an end of the first chamber that is opposite the gas circulating device and below an end of the second chamber that is opposite the gas circulating device.

2. The uniform flow control system according to claim 1, wherein the first chamber and the third chamber have the same cross-sectional area.

3. The uniform flow control system according to claim 1, wherein:

the first surface of the work chamber includes two vertical surfaces and the first chamber extends along and below the two vertical surfaces of the work chamber;

the second surface of the work chamber is a horizontal surface that extends between the two vertical surfaces of the work chamber and the second chamber extends along the horizontal surface between the first chamber that is below the two vertical surfaces of the work chamber; and the third chamber is continuous with the end of the first chamber that is opposite the gas circulating device and below the end of the second chamber that is opposite the gas circulating device.

4. The uniform flow control system according to claim 1, wherein:

the second chamber extends between the second surface of the work chamber and a first surface of a platform; and the third chamber extends along a second surface of the platform.

5. The uniform flow control system according to claim 4, further comprising:

at least one guide member that extends from the first surface of the platform toward the second surface of the work chamber.

6. The uniform flow control system according to claim 1, wherein the first chamber, the second chamber and the third chamber form an H-shaped chamber.

7. The uniform flow control system according to claim 1, wherein third chamber creates turbulence when the gas is circulated in the expansion chamber.

8. The uniform flow control system according to claim 1, wherein the first chamber, the second chamber and the third chamber are divided into at least two chambers that each guide gas to different zones of the work chamber.

9. A uniform flow control system for processing equipment with a plurality of work pieces located within the processing equipment, comprising:

an enclosure with a top wall, a bottom wall and side walls;

a gas circulating device that circulates gas and that is located at the top wall of the enclosure;

a first surface that generally vertically extends and in parallel spaced relation with the side walls of the enclosure;

a second surface that generally horizontally extends and in parallel spaced relation with the bottom wall of the enclosure, wherein the second surface is below the first surface and the second surface includes at least one opening; and a protrusion that is located at the bottom wall, wherein a top wall of the protrusion is located a first predetermined distance below the second surface and side walls of the protrusion are located a second predetermined distance from the side walls of the enclosure.

10. The uniform flow control system according to claim 9, wherein the first surface is located at both ends of the second surface.

11. The uniform flow control system according to claim 10, wherein a distance from the first surface to the side walls of the enclosure is the same as the distance from the side walls of the protrusion to the side walls of the enclosure.

12. The uniform flow control system according to claim 10, wherein the first surface extends between a front wall to a rear wall of the enclosure.

13. The uniform flow control system according to claim 9, wherein the gas circulating device circulates gas between the first surface and the side walls.

14. The uniform flow control system according to claim 13, where the gas circulating device initially circulates gas between the first surface and the side walls at an end of the first surface opposite the second surface.

15. The uniform flow control system according to claim 9, wherein at least one guide member extends from the top wall of the protrusion toward the second surface.

16. The uniform flow control system according to claim 15, where the at least one guide member is slanted from the top wall of the protrusion toward a center of the second surface.

17. The uniform flow control system according to claim 9, wherein the first surface includes at least one opening.

18. The uniform flow control system according to claim 9, wherein the first surface is a horizontal jet distribution plate and the second surface is a vertical jet distribution plate.

19. The uniform flow control system according to claim 9, wherein:

a first chamber extends between the top wall of the enclosure to the top wall of the protrusion and between the first surface and the side walls;

a second chamber extends between the second surface and the top wall of the protrusion and along part of a side of the first chamber;

a third chamber extends between a bottom of the first chamber and the bottom wall of the enclosure and between the side walls of the protrusion and the side walls of the enclosure.

20. The uniform flow control system according to claim 9, wherein a space between the side walls of the enclosure and the side walls of the protrusion is used to create turbulence when the gas circulates in the space.

21. The uniform flow control system according to claim 9, further comprising:

a divider that generally vertically extends between the first surface and the side walls, the second surface and the protrusion and in parallel spaced relation with a front wall and a rear wall of the enclosure.

22. The uniform flow control system according to claim 9, wherein the uniform flow control system is a batch furnace.

23. The uniform flow control system according to claim 9, wherein the uniform flow control system is a multi zone continuous furnace.

24. A uniform flow control system for processing equipment with a plurality of work pieces located within the processing equipment, comprising:

a gas circulating device that circulates gas;

a work chamber that can accommodate the plurality of work pieces;

an expansion chamber that is located outside the work chamber and that guides gas to the work chamber, the expansion chamber comprising:

a first chamber that extends along a first surface of the work chamber and that guides gas in a first direction into the work chamber;

a second chamber that extends along a second surface of the work chamber to a side of the first chamber and that guides gas in a second direction into the work chamber; and a third chamber that is in communication with the first chamber and the second chamber, wherein gas turbulence is created in the third chamber before the gas enters the second chamber.

* * * * *